US012276099B2

(12) United States Patent
Isaacs et al.

(10) Patent No.: US 12,276,099 B2
(45) Date of Patent: Apr. 15, 2025

(54) MODULAR BUILDING SYSTEMS

(71) Applicant: Vero Solutions Inc., Calgary (CA)

(72) Inventors: Scott Isaacs, Calgary (CA); Darrin Newnham, Calgary (CA)

(73) Assignee: Vero Solutions Inc., Calgary (CA)

( * ) Notice: Subject to any disclaimer, the term of this patent is extended or adjusted under 35 U.S.C. 154(b) by 14 days.

(21) Appl. No.: 17/294,945

(22) PCT Filed: Nov. 19, 2019

(86) PCT No.: PCT/CA2019/051651
§ 371 (c)(1),
(2) Date: May 18, 2021

(87) PCT Pub. No.: WO2020/102893
PCT Pub. Date: May 28, 2020

(65) Prior Publication Data

US 2022/0018112 A1 Jan. 20, 2022

Related U.S. Application Data

(60) Provisional application No. 62/769,275, filed on Nov. 19, 2018.

(51) Int. Cl.
*E04B 1/16* (2006.01)
*E04B 1/348* (2006.01)

(52) U.S. Cl.
CPC ..... *E04B 1/161* (2013.01); *E04B 1/34807* (2013.01)

(58) Field of Classification Search
CPC ... E04B 5/40; E04B 1/165; E04B 1/30; E04B 1/24; E04B 2001/2484; E04B 1/161;
(Continued)

(56) References Cited

U.S. PATENT DOCUMENTS 4,019,293 A * 4/1977 Armas ..... E04B 1/34823 52/79.11
4,037,375 A * 7/1977 Maggos ..... E04B 5/48 52/320

(Continued)

FOREIGN PATENT DOCUMENTS

GB 1336748 A 11/1973
WO 2013086638 A1 6/2013

OTHER PUBLICATIONS

European Patent Office, Extended European Search Report dated Jul. 13, 2022 for Application No. 19887840.7.

(Continued)

*Primary Examiner* — Basil S Katcheves
*Assistant Examiner* — Daniel J Kenny
(74) *Attorney, Agent, or Firm* — Norton Rose Fulbright Canada LLP; Maya Medeiros

(57) ABSTRACT

A building module for use in construction of a building comprising a deck oriented in a horizontal plane and a plurality of hollow structural members extending downwardly from around a periphery of the deck. A method of constructing a building comprising placing a plurality of modules according to a floor plan to form a story of the building, pouring flowable medium that sets to a become a solid structural material into the hollow structural members of the plurality of modules to form structural columns, pouring flowable medium that sets to a become a solid structural material onto the decks of the plurality of modules for form structural slabs, and allowing the structural columns and structural slabs to set to complete the story of the building.

17 Claims, 11 Drawing Sheets

(58) Field of Classification Search
CPC ..... E04B 1/34807; E04C 3/293; E04C 3/34; E04H 1/005
See application file for complete search history.

(56) References Cited

U.S. PATENT DOCUMENTS

| | | | | | |
|---|---|---|---|---|---|
| 4,081,935 | A * | 4/1978 | Wise | E04B 5/43 | 52/432 |
| 4,125,973 | A * | 11/1978 | Lendrihas | E04B 1/2403 | 249/188 |
| 5,050,358 | A | 9/1991 | Madislavic | | |
| 5,444,957 | A | 8/1995 | Roberts | | |
| 5,678,375 | A * | 10/1997 | Juola | E04B 1/24 | 52/236.7 |
| 6,151,851 | A | 11/2000 | Carter | | |
| 7,028,435 | B2 | 4/2006 | Walker | | |
| 9,038,339 | B2 * | 5/2015 | Zhong | B28B 1/29 | 52/259 |
| 9,096,999 | B2 * | 8/2015 | Rahimzadeh | E04C 3/293 | |
| 9,523,188 | B2 * | 12/2016 | Rahimzadeh | E04C 3/293 | |
| 9,683,361 | B2 * | 6/2017 | Timberlake | E04B 1/167 | |
| 10,738,463 | B2 * | 8/2020 | Miller | E04B 1/585 | |
| 2006/0265992 | A1 * | 11/2006 | Hiragaki | E04B 5/43 | 52/633 |
| 2014/0298745 | A1 * | 10/2014 | Rechenmacher | E04H 1/005 | 52/425 |
| 2019/0234063 | A1 * | 8/2019 | Garcia-Abril Ruiz | E06B 9/02 | |

OTHER PUBLICATIONS

International Search Report and Written Opinion, International Application No. PCT/CA2019/051651, dated Jan. 22, 2020.

* cited by examiner

MODULAR BUILDING SYSTEMS

TECHNICAL FIELD

The present disclosure relates to apparatus and methods for construction of modular buildings.

SUMMARY

In an aspect, there is provided building module for use in construction of a building. The module has a deck oriented in a horizontal plane, a plurality of hollow structural members extending downwardly from around a periphery of the deck, and at least one alignment component to facilitate self-alignment of the building module with another building module.

In some embodiments, the alignment component is one or more alignment flanges. In some embodiments, the alignment component is one or more alignment pin. The alignment components can be a combination of pins and flanges in some embodiments.

In some embodiments, the alignment component is made of rigid materials to provide structural support for the plurality of hollow structural members.

In some embodiments, the hollow structural members include columns. In some embodiments, the hollow structural members include beams. In some embodiments, the hollow structural members include a combination of columns, beams and other hollow areas of the module that can receive concreate.

In some embodiments, the deck is configured to support and engage flowable medium that sets to a become a solid structural material poured onto the deck. An example flowable medium that sets to a become a solid structural material is concrete.

In some embodiments, the deck involves one or more reinforcement members attached thereto and configured to provide structural support for a slab of set concrete formed on top of the deck.

In some embodiments, a hollow structural member of the plurality of hollow structural members is shaped to connect with another hollow structural member of the other building module using the set flowable medium or solid structural material within the hollow structural member and the other hollow structural member. Accordingly, the hollow structural member can act as a connecting component to another module (or hollow structural member thereof).

In some embodiments, the alignment component extends upwardly from the hollow structural member.

In some embodiments, the alignment component facilitates alignment in the vertical direction and horizontal direction.

In some embodiments, the alignment component facilitates alignment in the vertical direction.

In some embodiments, a hollow structural member of the plurality of hollow structural members is shaped to receive a tie bar of another hollow structural member of another building module. This can also provide connecting components for the members.

In some embodiments, a hollow structural member of the plurality of hollow structural members has a built-in tie bar extending from the top thereof.

In some embodiments, the plurality of hollow structural members are of a rigid material to support flowable medium that sets to a become a solid structural material (e.g. wet concrete) and shaped to receive the flowable medium that sets to a become a solid structural material to become a plurality of filled hollow structural members.

In some embodiments, each of the plurality of hollow structural members comprise an injection port for the flowable medium that sets to a become a solid structural material.

In some embodiments, the attachment mechanism to connect to another building module to provide a water barrier during erection and placement of the flowable medium that sets to a become a solid structural material.

In another aspect, embodiments described herein provide a method of constructing a building. The method involves placing modules according to a floor plan to form a story of the building, each module comprising a deck oriented in a horizontal plane, and a plurality of hollow structural members extending downwardly from around a periphery of the deck. The method involves aligning the plurality of modules using alignment components integrated within the plurality of modules. The method involves pouring flowable medium that sets to a become a solid structural material into the hollow structural members of the plurality of modules to form structural columns. The method involves pouring flowable medium that sets to a become a solid structural material onto the decks of the plurality of modules for form structural slabs. The method involves allowing the structural columns and structural slabs to set to complete the story of the building.

In some embodiments, the method involves aligning the plurality of modules by placing a first axial end of a first hollow structural member over a second axial end of a second hollow structural member to cause the second hollow structural member to engage an alignment component of the first hollow structural member.

In some embodiments, the method involves pouring flowable medium that sets to a become a solid structural material into the hollow structural members by, before pouring flowable medium that sets to a become a solid structural material into the hollow structural members, aligning a first hollow structural member with a second hollow structural member by placing a first axial end of a first hollow structural member over a second axial end of a second hollow structural member to cause the second hollow structural member to engage an alignment component of the first hollow structural member and to lock the first hollow structural member relative to the second hollow structural member.

In another aspect, embodiments described herein provide an assembly of building modules for use in construction of a building. The assembly has a first module including a first set of hollow structural members, each of the first set of hollow structural members having a connecter end with at least one alignment component; a second module including a second set of hollow structural members, each of the second set of hollow structural members having a receptacle end receiving at least a portion of the first set of hollow structural members and engaging with the at least one alignment component of one of the first set of hollow structural members, wherein the first and second modules are vertically aligned by the at least one alignment component to form a structure of a building.

In some embodiments, each of the first and second sets of hollow structural members has a hollow inner core and an injection port configured to receive wet flowable medium that sets to a become a solid structural material inside the hollow inner core.

In an aspect, embodiments described herein provide a building module for use in construction of a building comprising a deck oriented in a horizontal plane and a plurality of hollow structural members extending downwardly from around a periphery of the deck.

In an aspect, embodiments described herein provide a building module for use in construction of a building, the module comprising a deck oriented in a horizontal plane, a plurality of hollow structural members extending downwardly from around a periphery of the deck, a connection component to connect to another module, and at least one self-aligning component to facilitate vertical alignment of the building module the other building module, wherein the self-aligning component provides structural support for the plurality of hollow structural members.

Another aspect provides a method of constructing a building comprising placing a plurality of modules according to a floor plan to form a story of the building, pouring flowable medium that sets to a become a solid structural material into the hollow structural members of the plurality of modules to form structural columns, pouring flowable medium that sets to a become a solid structural material onto the decks of the plurality of modules for form structural slabs, and allowing the structural columns and structural slabs to set to complete the story of the building.

Further aspects and details of example embodiments are set forth below.

DRAWINGS

The following figures set forth embodiments in which like reference numerals denote like parts. Embodiments are illustrated by way of example and not by way of limitation in the accompanying figures.

DETAILED DESCRIPTION

Figure 1:
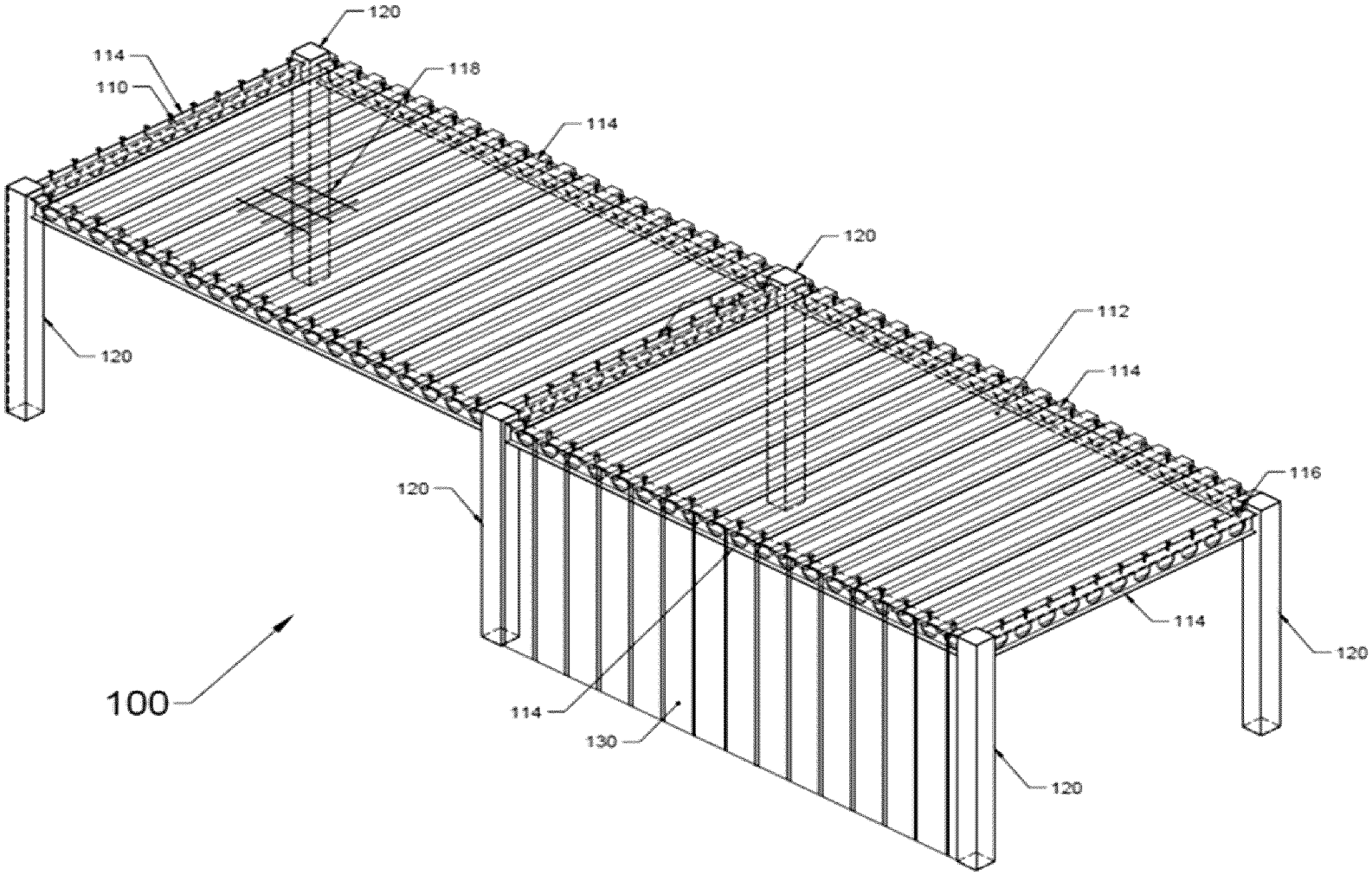
FIG. 1 is a perspective view of an embodiment of a module 100.

Embodiments described herein relate to modules for construction of buildings, and methods for constructing buildings with such modules. In some embodiments, the modules are configured to accommodate construction of mid-rise and high-rise buildings, and are also useful for construction of buildings with lower heights.

The modules are configured to be placed according to a desired floor plan to form a building story on a supporting surface. The supporting surface may be a foundation or a previously completed building story. A module can have alignment component to facilitate alignment of the module with another building module. The alignment component can be used to align the module in place relative to other modules. The alignment component can be referred to herein as an alignment flange or an alignment pin, for example. The alignment components can be self-aligning in that it aligns the module itself with another module. Accordingly, the module can have self-aligning components, such as self-aligning alignment pins, for example. The alignment components can align the module with another module by bringing the module into a range of vertical alignment during placement, for example. For example, self-aligning alignment pin(s) can function to either bring module to within 3 mm of vertical alignment during placement. As another example the alignment components can bring the module into horizontal alignment with another module. As another example the alignment components can bring the module into vertical alignment and horizontal alignment with another module.

The module can connect to another module using different connecting components. One or more alignment components can be integrated as part of the components used to connect a module to another module, for example. The alignment components can also provide additional structural support at the joint between upper and lower horizontal structural members (e.g. columns). The upper and lower horizontal structural members of modules can be used to as connecting components to connect the modules. The alignment components can be made a rigid material.

A module can have hollow structural members extending downwardly from the deck of the module. The module can connect to another module using different connecting components that can be provided by hollow structural members or integrated with hollow structural members. The hollow structural members can extend downwardly from around a periphery of the deck. In some embodiments, one or more alignment components are within or integrated with a hollow structural member.

A hollow structural member can include a column, for example. A column can work in tandem with the flowable medium that sets to a become a solid structural material (poured into the module and hollow structural members) to create the required fire rating (e.g. 3 hours) for high rise construction. However, in some embodiments, there are other hollow structural members such as composite steel and concrete beams on the horizontal plane. An illustrative example of the flowable medium that sets to a become a solid structural material is concrete. Other example flowable mediums can also be used and the references to concrete herein are examples.

The hollow structural members can be made of rigid material. The hollow structural members can receive and support the flowable medium that sets to a become a solid structural material such as wet concrete. That is, the flowable medium that sets to a become a solid structural material can be poured into the hollow structural members and supported thereby until it sets. The hollow structural members can have different structures, shapes, and configurations. The hollow structural members provide support and can receive flowable medium that sets to a become a solid structural material.

Once the modules are in place, the flowable medium that sets to a become a solid structural material is poured into columns of the modules and over decks of the modules. The flowable medium allowed to set to complete the building story. In some embodiments, the modules, together with the flowable medium set to become a solid structural material, comprise all or substantially all of the structural system of the building.

In some embodiments, modules according to the present disclosure may be used to construct buildings having less concrete than buildings made with some prior art construction methods. In some embodiments, modules according to the present disclosure may be used to construct buildings while requiring less formwork than when constructing buildings according to some prior art construction methods.

In some embodiments, the modules have reinforcement members pre-installed on the decks and/or in the columns thereof. In other embodiments, reinforcement members may be placed on-site. The reinforcement members may, for example, comprise steel bars, wire mesh, or other structurally reinforcing elements.

In some embodiments, the interiors of the modules are partially or fully furnished, other than the floors. In some embodiments, the exteriors of the modules may also be partially or fully finished.

For simplicity and clarity of illustration, reference numerals may be repeated among the figures to indicate corresponding or analogous elements. Numerous details are set forth to provide an understanding of the examples described herein. The examples may be practiced without these details. In other instances, well-known methods, procedures, and components are not described in detail to avoid obscuring the examples described. The description is not to be considered as limited to the scope of the examples described herein.

FIG. 1 is a perspective view of an embodiment of a module 100. The module 100 comprises a structural deck 110 having a plurality of hollow structural columns 120 extending downwardly therefrom. The hollow structural columns may be referred to as hollow structural members. One or more wall assemblies 130 may be installed between the columns 120. The hollow structural members can be used to connect modules together, for example. The hollow structural members can receive flowable medium such as wet concrete (used as an illustrative example). The module 100 has an attachment mechanism or connection component to connect the module 100 to another module 100. Some of the components such as the alignment components and/or the hollow structural columns can be used to provide connection components, for example.

Only one wall assembly 130 is shown in FIG. 1, but it is to be understood that the number and configuration of wall assemblies 130 can vary depending on the design and intended use of the building. Each wall assembly 130 may, for example, include one or more doors, windows, built-in storage, workstations, furniture, and/or other features. The exteriors of the wall assemblies 130 of certain modules may also be finished in some embodiments.

The columns 120 may be distributed about the perimeter of the deck 110 and spaced apart as required to support the expected loads. In the illustrated example, the module 100 comprises a rectangular deck 110, with six columns 120 distributed with four at the corners of the deck 110 and two at the midpoints of the longer sides. In other embodiments, the deck 110 may have a different shape, and/or a different number of columns 120 may be provided.

The deck 110 is constructed from a rigid material configured to support a concrete floor poured thereon, and textured to engage the concrete. As noted, the module includes hollow structural members. The hollow structural members can include beams 114. These can be composite steel and concrete beams 114, for example. In the illustrated example, the deck 110 is constructed from a corrugated steel panel 112 with beams 114 attached between the columns 120 around the edges thereof. Another beam 114 extends between the two columns 120 at the midpoint of the deck 110. The beams 114 may, for example, comprise steel I-beams or open-web steel joists. The beams 114 may have studs 116 welded there above and extending upwardly therefrom to engage concrete. The studs 116 may be welded to join the underlying portion of the panel 112 and beam 114 in one puddle of weld material. The beams 114 can be composite, castellated, dropped I beams, flush girder beams, open web joists, or a combination thereof, for example. The beams 114 can be composite beams as shown in the example illustration.

In some embodiments, the deck 110 may have reinforcement members 118 pre-installed thereon. In the illustrated example, the reinforcement members 118 comprise a grid of steel bars, only a portion of which is shown in FIG. 1, but which may extend across the whole upper surface of the deck 110.

The columns 120 are hollow, and the tops of the columns 120 may be slightly higher than the deck 110. After the module 100 is in place, concrete is poured down through the interiors (or hollow inner core) of the hollow structural members (including columns 120), and then on the deck 110, as described below. In some embodiments, the tops of the columns 120 can have alignment components such as flanges extending upwardly therefrom to facilitate alignment of another column (or hollow structural member) directly there above. The modules connect and the alignment flanges are used to align the connecting modules. This can provide vertical alignment of the modules within a range (e.g. 2-4 mms of vertical alignment) The columns 120 of the modules can be used to connect modules and provide connecting components for the modules, for example.

Figure 2A:
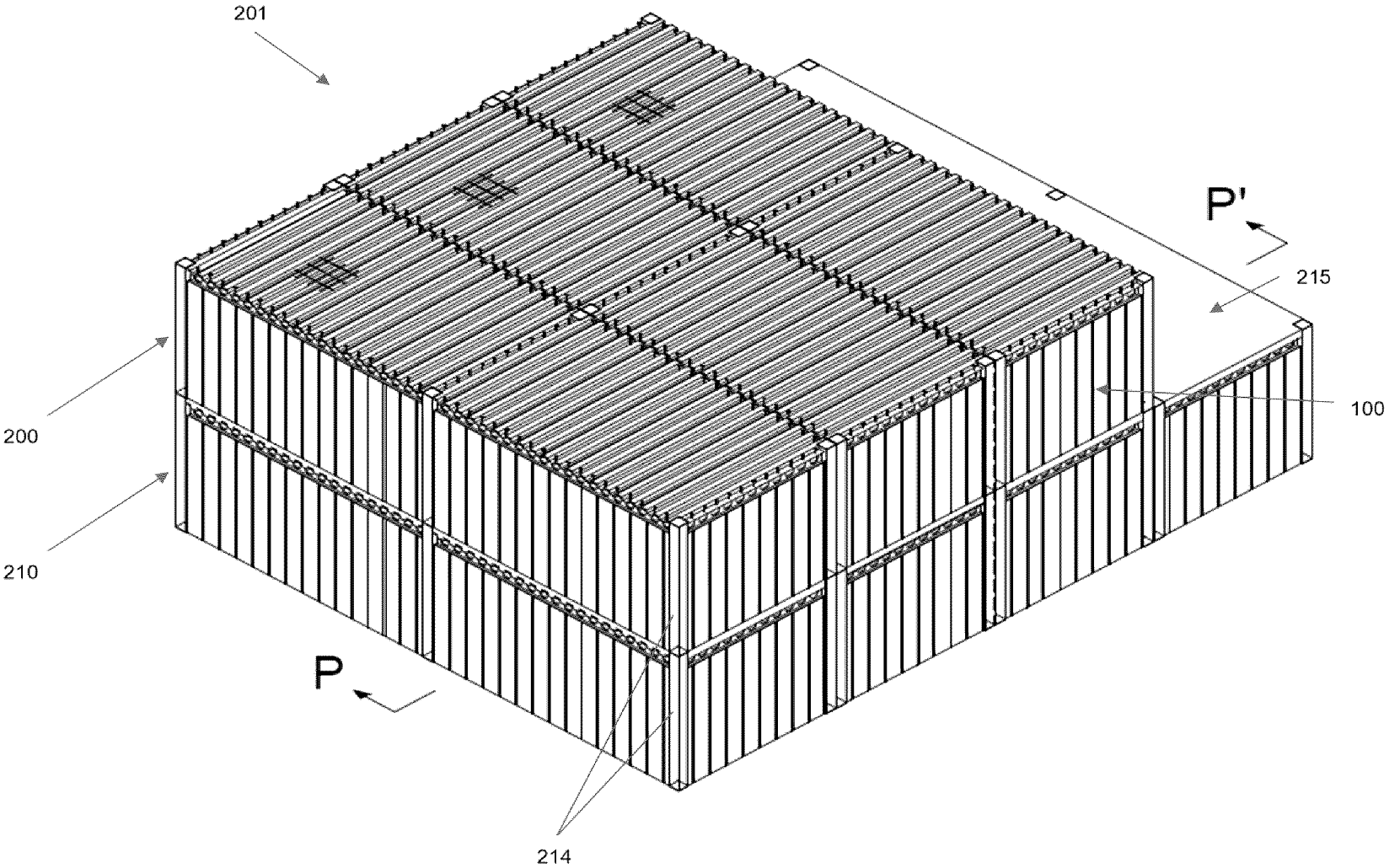
FIG. 2A is a perspective view of a building construction utilizing a plurality of modules to form an assembly.

FIG. 2A is a perspective view of a building construction utilizing a plurality of modules to form an assembly 201.

The assembly 201 comprises a plurality of modules 100, which are connected according to aspects of the present disclosure. In particular, seven modules forming a first previously completed story 210 and partially forming a second new story 200. An area 215 does not have any modules 100 installed therein. The assembly comprises filled columns 214: structural elements which are hollow structural members filled with concrete. Aspects of the present disclosure may facilitate modular construction by allowing an easy and/or rapid way to align the hollow structural members prior to pouring wet concrete in them. When the wet concrete sets (after curing), the column may form a composite structure with enhanced material characteristics suitable for a structural column, e.g. increased yield stress, flexural stress, increased ability to withstand hoop stresses, increased rigidity, or improved fatigue resistance.

Figure 2B:
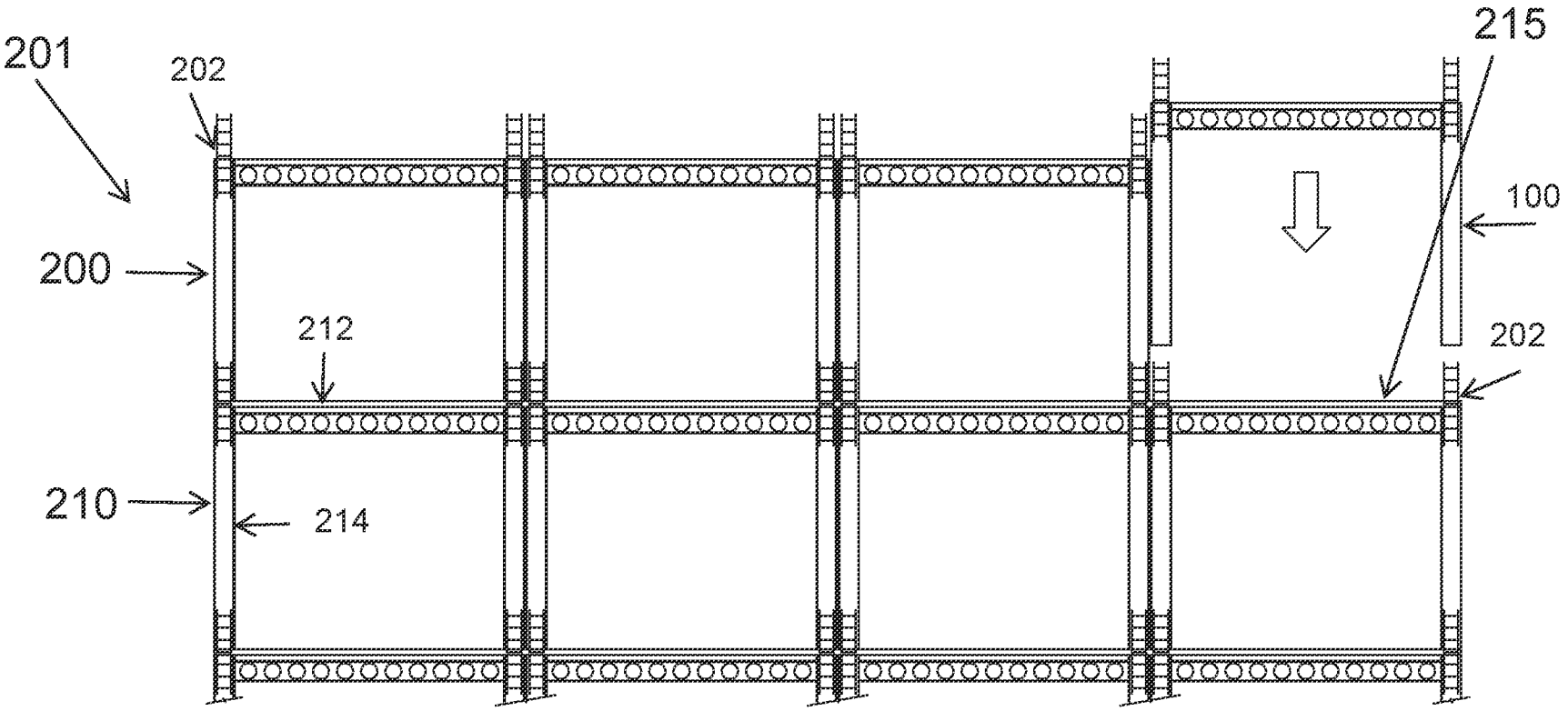
FIG. 2B is a cross-section of the assembly of FIG. 2A, shown with an additional module positioned but prior to installation.

FIG. 2B is a cross-section of the assembly 201 of FIG. 2A, the cross-section taken along P-P' indicated in FIG. 2A, shown with an additional module positioned but prior to installation above the area 215.

Figure 2C:
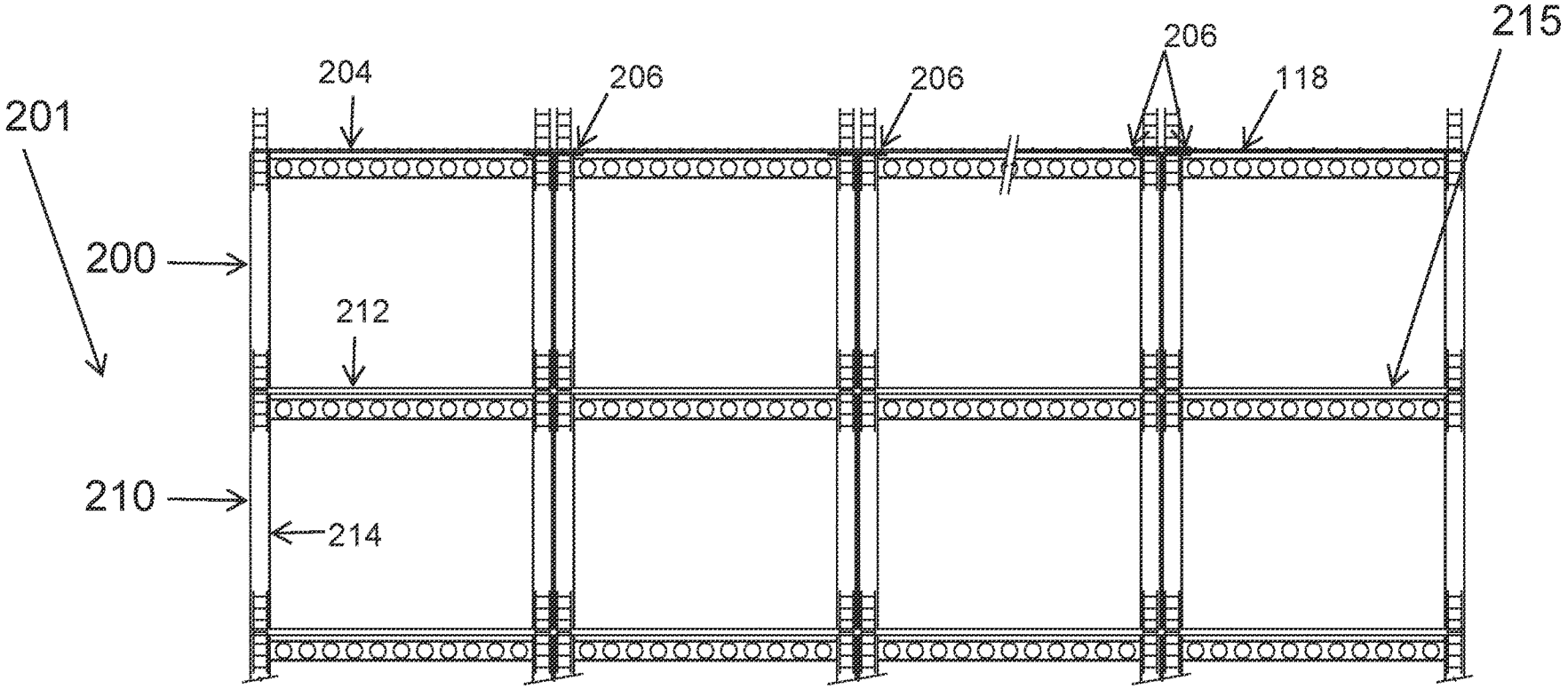
FIG. 2C is a cross-section of the assembly of FIG. 2A, shown with an additional module installed.

FIG. 2C is a cross-section of the assembly 201 of FIG. 2A, the cross-section taken along P-P' indicated in FIG. 2A, shown with an additional module installed above the area 215.

Figure 2D:
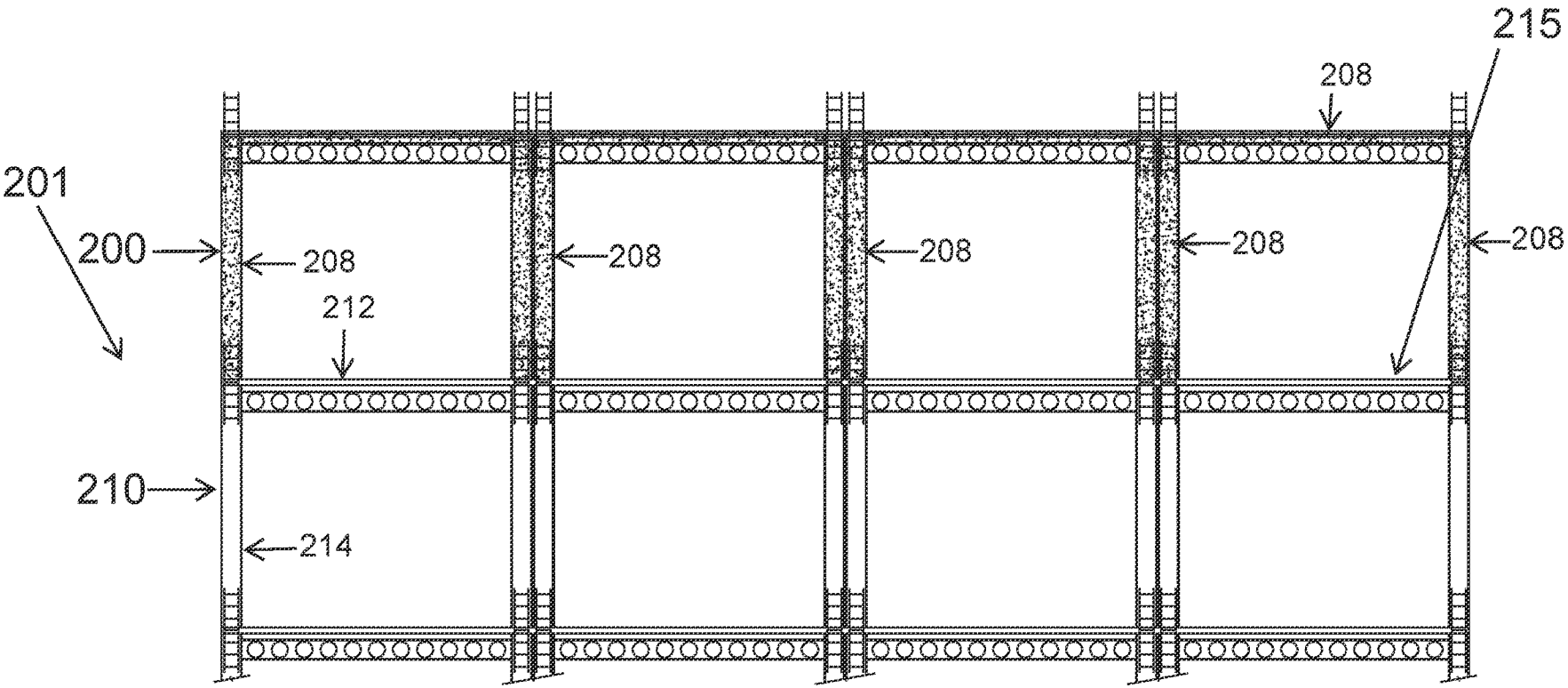
FIG. 2D is a cross-section of the assembly of FIG. 2A, shown with an additional module installed, filled with flowable medium that sets to a become a solid structural material which is then allowed to set.

FIG. 2D is a cross-section of the assembly 201 of FIG. 2A, the cross-section taken along P-P' indicated in FIG. 2A, shown with an additional module installed, filled with wet concrete which is then allowed to set above the area 215.

FIGS. 2B, 2C and 2D show an example method for constructing a building according to one embodiment of the present disclosure. As shown in FIG. 2B, a plurality of modules (such as, for example module 100 of FIG. 1), are placed according to a floor plan to form a new building story 200. The modules of the new building story 200 are placed on a supporting structure, which may comprise a foundation (not shown), or a previously completed story 210. Column tie bars 202 are provided in the supporting structure to be received within the columns of the modules. In some embodiments, the columns of the modules have built-in column tie bars 202 extending from the tops thereof (other than the columns of the top-most story). The column tie bars 202 can be used to connect to columns 120 of another module 100, for example. The column tie bars 202 are an example of connecting components. There can be other connection components to connect the columns 120 vertically to one another. The figures illustrate different methods, such as a tied rebar cage placed into the column before we pour concrete and an alignment flange pin with pre-installed reinforcement.

Tie bars or column tie bars 202 are an example of a structural member used for reinforcing a structure. The tie bars are elongated along a longitudinal axis thereof and may be substantially solid. In some embodiments, the tie bar is a rod of reinforcement steel (also known as rebar). The column tie bars 202 are an example connecting component for the modules. Another example is the alignment components as they can help align and connect the modules.

As shown in FIG. 2D, once the modules of the new building story 210 are in place, deck reinforcement members 204 and inter-module reinforcement members 206 are placed on top of the decks of the modules. The deck reinforcement members 204 may, for example, comprise a wire mesh or a grid of steel bars, such as reinforcement members 118 shown in FIG. 1. The module includes hollow structural members which can include the deck reinforcement members 204. These can be beams such as composite steel and concrete beams on the horizontal plane.

The inter-module reinforcement members 206 may, for example have steel bars placed in the troughs of corrugated steel panels of the decks. In some embodiments, the inter-module reinforcement members 206 are preinstalled on the modules.

As shown in FIG. 2D, concrete 208 is poured into columns of the modules, then immediately after the columns are filled, concrete is poured to cover the deck of the modules. The concrete 208 is then allowed to set to form a complete story 210 having a floor slab 212 and a plurality of filled columns 214.

Figure 3A:
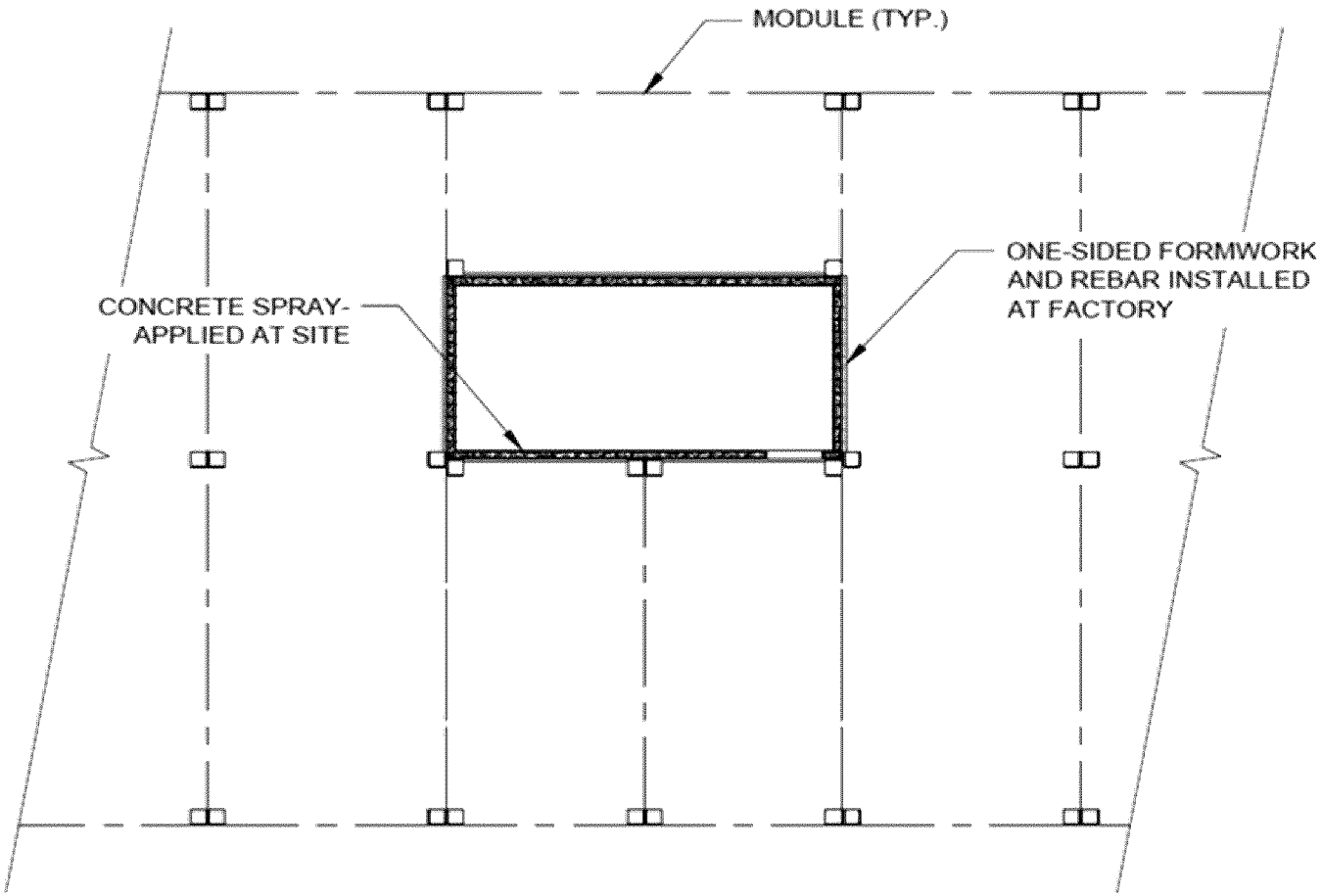
FIG. 3A is a plan view of an example building having a stair/elevator core 300 formed by modules according to embodiments described herein.

FIG. 3A is a plan view of an example building having a stair/elevator core 300 formed by modules according to the present disclosure.

Figure 3B:
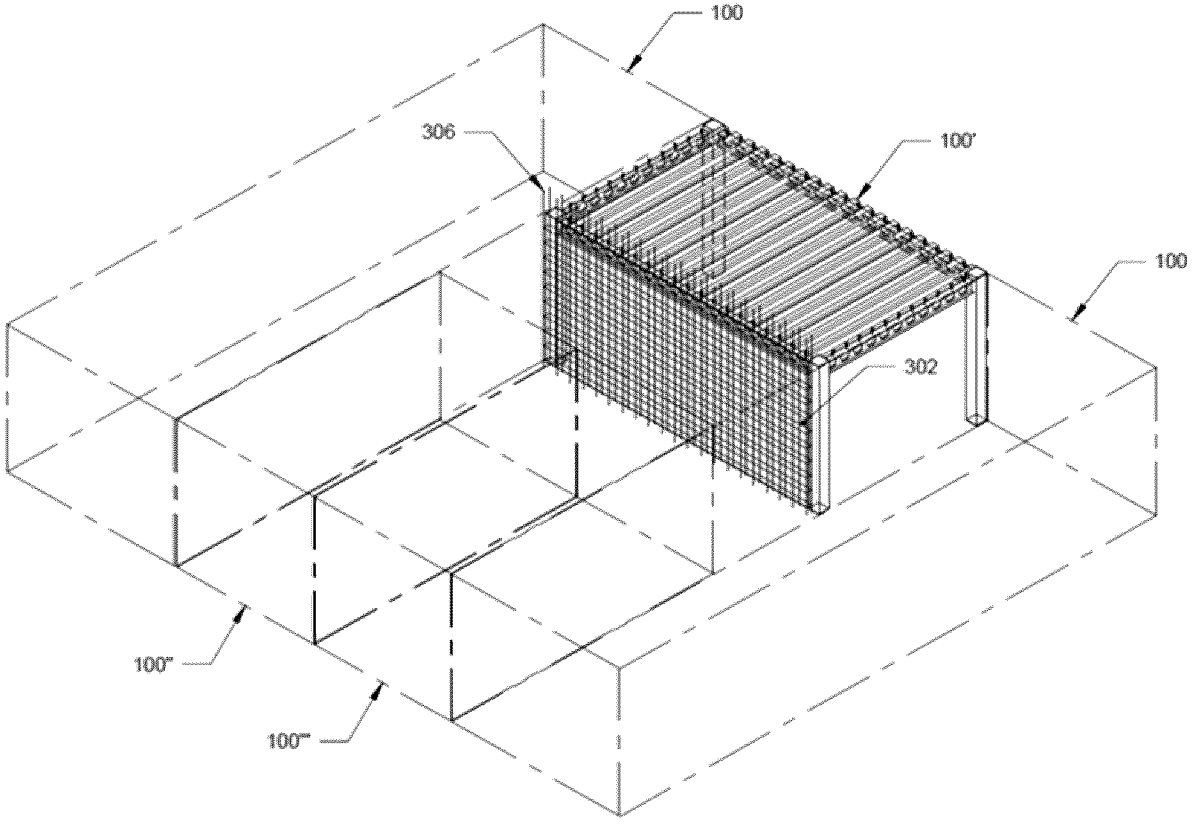
FIG. 3B is a partial perspective view of the example building of FIG. 3A.

FIG. 3B is a partial perspective view of the example building of FIG. 3A.

In reference to FIGS. 3A and 3B, the example building includes two modules 100 according to the embodiment of FIG. 1, and three modules 100', 100" and 100'" with different geometries that surround the core 300, each of which modules includes formwork 302 incorporated into the exterior sides of portions of the wall assemblies thereof. Such formwork 302 is configured to support sprayed concrete 304 such that the core 300 can be formed on-site as the building is constructed. As shown in FIG. 3B, in some embodiments the modules also have core reinforcement members 306 pre-installed on the walls thereof.

Figure 4A:
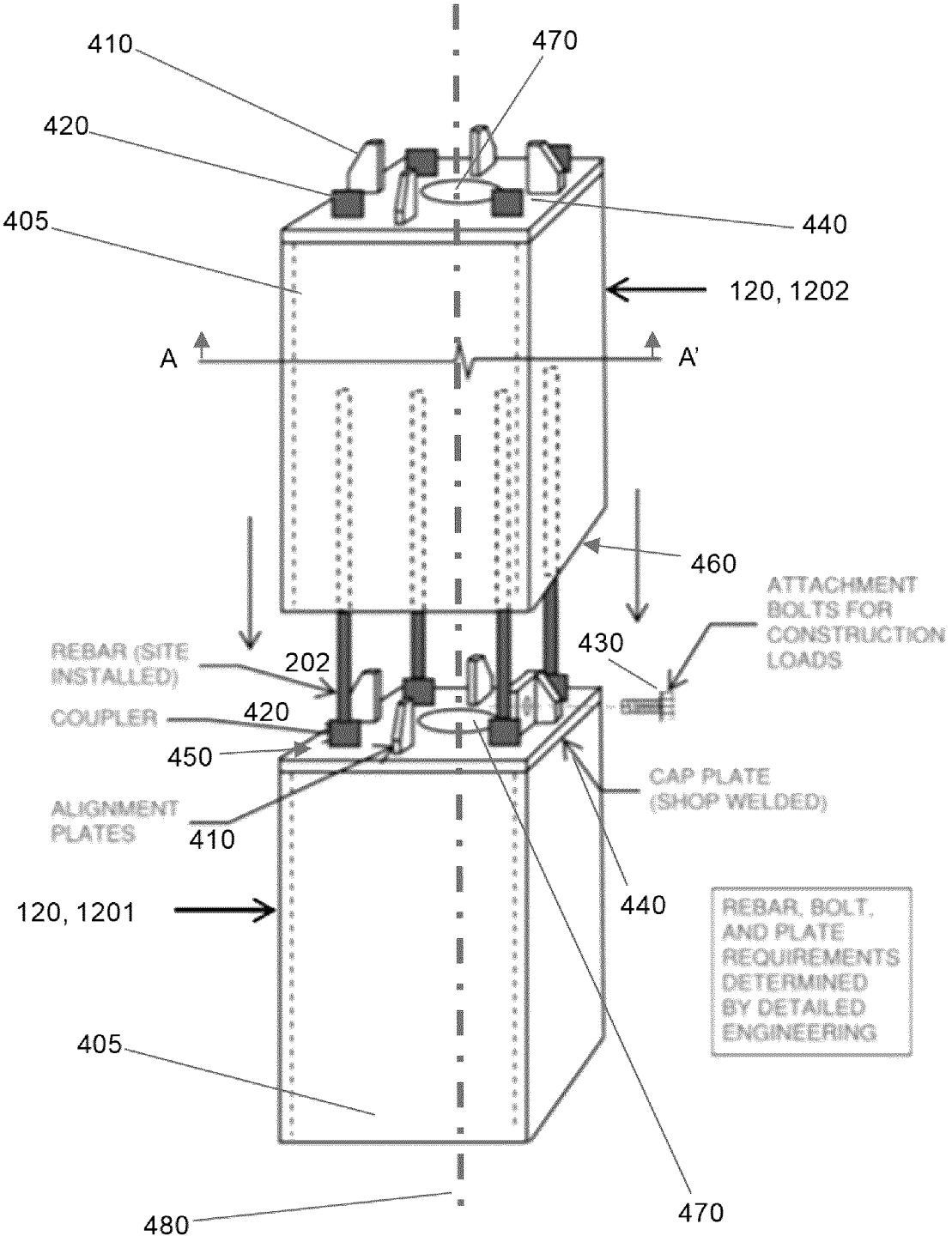
FIG. 4A is a perspective view of columns of two building modules and a connection between them, according to embodiments described herein.

FIG. 4A is a perspective view of columns 120 of two building modules 100 and a connection between them, according to aspects of the present disclosure.

Figure 4B:
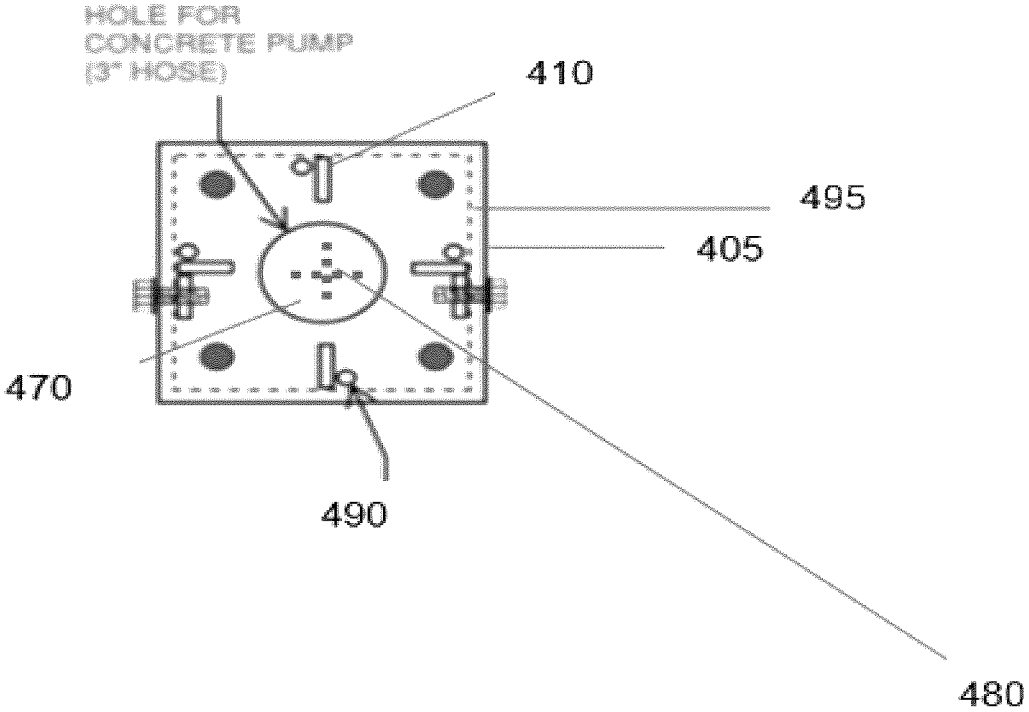
FIG. 4B shows a cross-sectional view of the columns of FIG. 4A and their connection.

FIG. 4B shows a cross-sectional view of the columns of FIG. 4A and their connection, the cross-section taken along A-A' indicated in FIG. 4A.

In reference to FIGS. 4A and 4B, the columns 120, 1201, 1202 are hollow structural members. The columns 120, 1201, 1202 can be vertical. They can have other shapes, configurations and orientations. For example, in some embodiments, the columns 120, 1201, 1202 may be horizontal and the connection between them may be a horizontal connection.

A column 120, 1201, 1202 has a longitudinal axis. The column 120, 1201, 1202 may be at least partially defined by an outer wall 405 surrounding a hollow inner core extending along the longitudinal axis 480. The outer wall 405 may include structural steel such as reinforcement steel. In some embodiments, "outer wall" may refer to a single continuous outer wall formed around the longitudinal axis 480 of the column 120, 1201, 1202 and in other embodiments it may describe a plurality of structural members joined together to form a single outer wall. In various embodiments, the outer wall 405 may include or may be made of other structural materials, e.g. fiber-reinforced composites, cast iron, prestressed concrete, and structural composite lumbar. In some embodiments, the outer wall 405 may be wholly made of structural steel.

An axial end of the column 1201 may be a connector end 450. The connector end 450 of the column 1201 may have tie bars 202 extending axially outwardly from the column 1201. The tie bars 202 may be attached to a wall formed at the connector end 450 and perpendicular to the longitudinal axis, referred to herein as the cap wall 440.

The cap wall 440 is made of a structural material, such as those mentioned above. In some embodiments, the cap wall 440 may be substantially made of the same material as the outer walls of the column 1201. The cap wall 440 may be a cap plate of the column. The cap plate 440 may be substantially flat or otherwise have protrusions. The cap plate 440 may be attached to the column 1201. The cap plate 440 may so be irremovably attached to the column 1201. In various embodiments, the cap plate 440 is welded, fastened by means of threaded fasteners, or riveted onto the column 1201.

The tie bars 202 may be welded on to the cap wall 440. In some embodiments, the tie bars 202 are attached to the cap wall 440 using a fastener 420. The fastener 420 may be a threaded fastener, e.g. the tie bar 202 may be threaded on to fastening bolts welded on to two (axially) opposed sides of the cap wall 440, one side within the hollow inner core and the other outside. In some embodiments, the fastener may be a coupler 420 configured to threadably receive tie bars 202 at both coupler axial ends. In some embodiments, the coupler 420 is welded onto the cap plate 440. The coupler 420 may pass through the cap wall 440 and present a threaded receptacle on two (axially) opposed sides of the cap wall 440, one side within the hollow inner core and the other outside.

An axial end of the column 1202 may be a receptacle end 460 configured to receive, and complementary to, tie bars 202 as they may be assembled on a connecter end 450 of a column. In some embodiments, the receptacle end 460 of a column 1202 of a module receives a connecter end 450 of a column 1201 of another module. In other embodiments, the receptacle end 460 of a column 1202 of a module receives tie bars 202 attached to a supporting structure. In some embodiments, the receptacle end 460 is substantially open to receive the tie bars 202, the tie bars 202 then passing through the hollow inner core of the column 1202 and engaging with one side of the cap wall 440 of the column 1202, e.g. by being welded thereonto or being threadably fastened to a coupler 420 presenting a threaded receptacle on two (axially) opposed sides of the cap wall 440, one side within the hollow inner core and the other outside. In other embodiments, the tie bars 202 may engage with other positioning or fastening elements at the receptacle end 460 or within the hollow inner core.

The connecter end 450 of the column 1201 includes alignment flanges 410. Alignment flanges 410 may be referred to as alignment members. The alignment flanges 410 may be protrusions extending in an outward direction away from the connecter end 450 of the column 1201. Alignment flanges 410 may be alignment plates comprising flat plates protruding axially outwardly from the connector end 450 and having an edge attached to the cap wall 440. The edge may be welded or fastened on to the cap wall 440. In some embodiments, wherein a cross-sectional plane of the columns 1201 (normal to the longitudinal axis 480) has a polygonal perimeter with N sides (and is axially uniform), the connecter end 450 may include N alignment flanges 410 configured to engage the N outer wall 405 of a second column 1202. The alignment flanges 410 may so engage with the inside of the outer wall 405 of the second column 1202 at a receptacle end 460 thereof. The inside of the outer wall 405 is indicated as a dashed line 495 in FIG. 4B. In some embodiments of columns with a 4-sided outer wall (rectangular column), the connector end 450 may include four alignment flanges 410. Each of the alignment flanges 410 may be positioned on the connecter end 450 such that the radially (with respect to the longitudinal axis 480) outermost part of the alignment flange 410 abuts or applies a force against the inside of an outer wall 405 of the second column 1202, when the receptacle end 460 of the second column 1202 is placed over the connecter end 450 of the first column 1201. Such an arrangement of alignment flanges 410 is evident from FIG. 4B, wherein the radially outermost part of the alignment flange 410 is shown adjacent to the dashed line 495 representing the inside of the outer wall 405 of the second column 1202. In some embodiments, the alignment flanges 410 may be configured to generate a stress on the inside of the outer wall 405 of the second column 1202 to substantially lock or hold the second column 1202 in-place relative to the first column 1201. By ensuring substantially fixed and correctly aligned positioning of the columns 1201, 1202 (also referred to herein as self-aligning connections or columns), such a locking or holding in-place may facilitate further construction around columns 120, 1201, 1202, e.g. it may facilitate reinforcement of columns 120 using wet concrete as well be discussed later.

Alignment flanges 410 may be alignment pins or plates, and may be configured to be received or otherwise engaged by complementary alignment receptacles. The alignment receptacles may be part of a receptacle end 460 of a second column 1202. In some embodiments, alignment flanges 410 may be locating pins comprising a cylindrical shaft having a flattened end configured to mate or engage with a complementary alignment hole at a receptacle end 460 of the second column 1202.

The column 1201 may have an injection port 470 for receiving a material for filling the hollow inner core of the column 1201. In some embodiments, the injection port 470 comprises an opening in the cap wall 440 permitting injection of material such as wet concrete into the hollow inner core. In some embodiments, when the columns 120 are erected substantially vertically with the connector ends 450 facing upwards, the pouring in of wet concrete may be accelerated or otherwise facilitated by gravity. In other embodiments, the injection port 470 may be configured to receive an outlet of a pump, the pump pushing a liquid, granular, or otherwise semi-solid material into the hollow inner core.

In some embodiments, some columns 120 may only have a receptacle end 460. In some embodiments, some columns 120 may only have a connector end 450. In some embodiments, some columns 120 may have both. In various such embodiments, i.e. with only a receptacle (or connecter) end, an axial end of the column opposed to the receptacle (or connector) end may be open, partially open, or closed, e.g. flat plate with or without openings may be welded or otherwise attached onto the axial end opposed the receptacle (or connector) end. In embodiments such as those shown in FIGS. 2A-2C, wherein building modules are stacked vertically and joined to each other via their columns, the bottommost module may have columns with only connecter ends (at axially uppermost ends of the columns) being received by receptacle ends of the building module above the bottommost module. In such embodiments, the topmost module may have columns with only receptacle ends (at axially bottommost ends of the columns) configured to receive connecter ends of the building module below the uppermost module.

The column 1201 may comprise one or more vent holes 490. The vent holes 490 may facilitate an exchange of gas between an interior of the column 1201 and an exterior thereof. In some embodiments, the vent holes 490 may facilitate curing and setting of wet concrete poured into the hollow inner core of the column 1201.

The connecter end 450 may include attachment bolts 430 for construction loads. The attachment bolts 430 can be optional. The attachment bolts 430 can be optional for temporary connection and/or for hoisting the module during erection. In some embodiments, the attachment bolts 430 are not required or used. The connecter end 450 is an example of an attachment mechanism or connection component to connect a module to another module.

Figure 5:
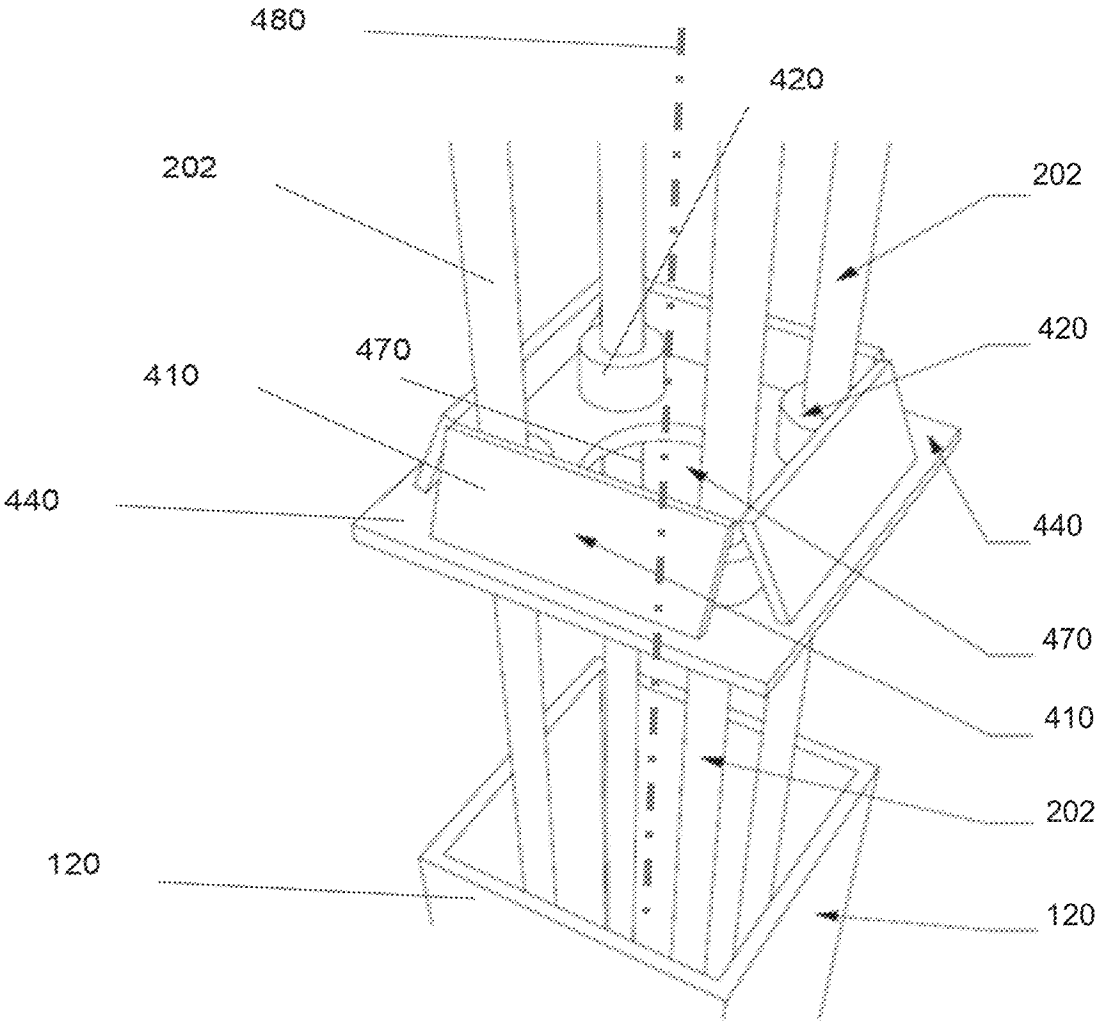
FIG. 5 is a partially exploded view of the connection between two columns, according to some embodiments.

FIG. 5 is a partially exploded view of the connection between two columns 120, according to some embodiments. The cap wall 440 is a cap plate, which may be made of structural steel. The cap plate 440 is substantially rectangular, wherein the each of the four corners of the rectangular cap plate 440 has a coupler 420 welded thereonto. A longitudinal axis of the couplers passes through the cap plate. Each coupler 420 has at least one tie bar 202 threadably engaged thereonto. The tie bars 202 may additionally be welded onto the couplers 420, the cap plate 440, or both couplers 420 and cap plate 440. The cap plate 440 has four alignment flanges 410, the alignment flanges 410 being alignment plates. Each alignment plate 410 is positioned at and substantially spans an edge of the cap plate 440. Furthermore, each alignment plate 410 is inclined with respect to the vertical (longitudinal 480) direction, such that portions of the alignment plate 410 further away from the cap plate 440 are radially inward relative to portions of the alignment plate 410 closer to the cap plate 440. Such an arrangement facilitates a placement (or sliding) of a receptacle end 460 of a second column over the cap plate 440 and tie bars 202 attached thereonto, since an obstruction of the outer wall 405 of the second column may be generated (or increased) as the receptacle end 460 of the second column is progressively brought closer to the cap plate 440. For example, as the receptacle end 460 is brought closer to the cap plate 440, the alignment plate 410 may generate a greater stress against (or material deformation of) the inside of the outer wall 405 of the second column.

Figure 6:
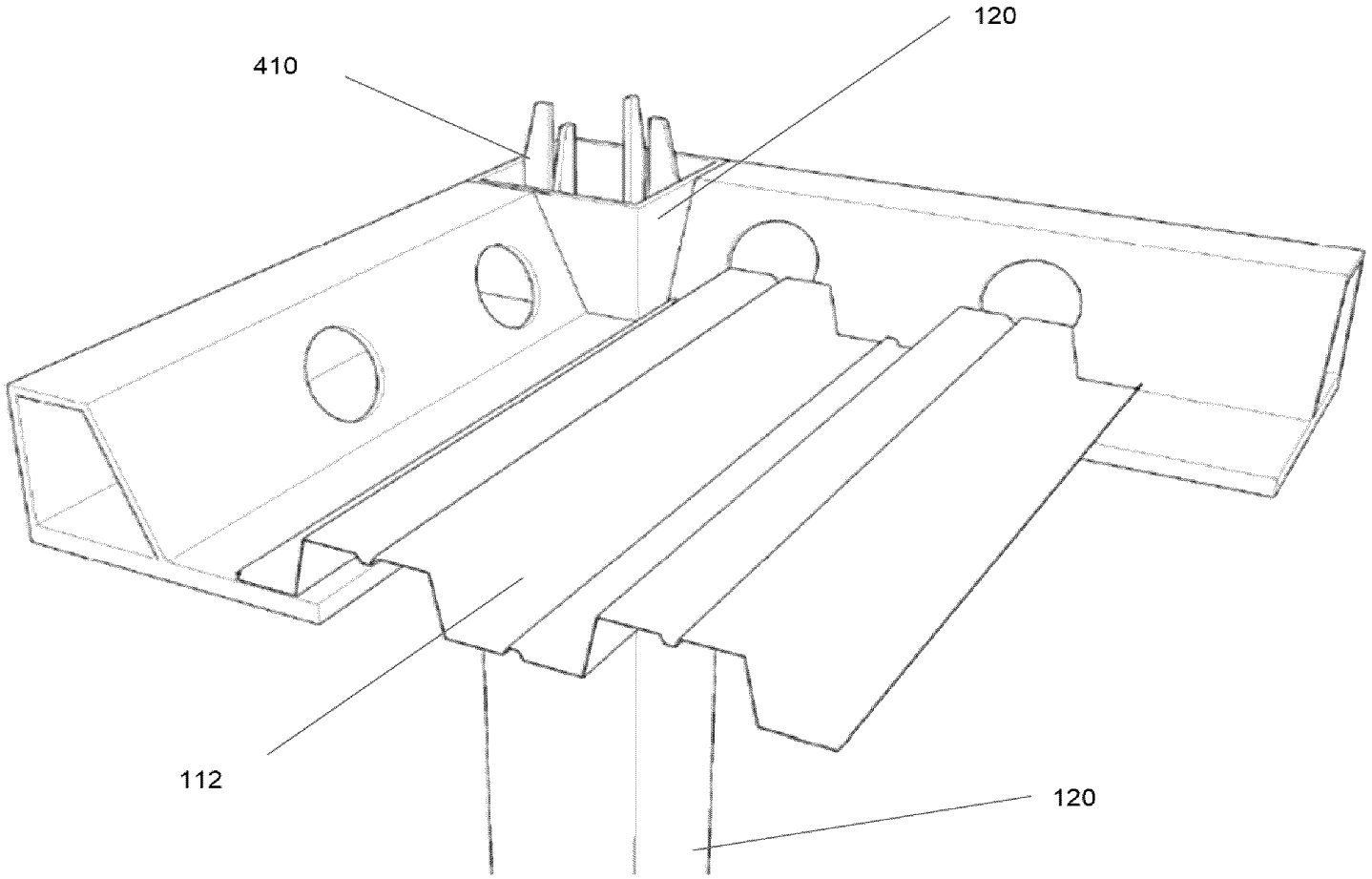
FIG. 6 is a partial perspective view of a building module according to an embodiment, the view showing a top corner of the building module with a column having alignment flanges protruding outwardly therefrom.

FIG. 6 is a partial perspective view of a building module 100 according to an embodiment, the view showing a top corner of the building module with a column 120 having alignment flanges 410 protruding outwardly therefrom. In this embodiment, an axial end of the column 120 (or hollow structural member) does not have attached thereonto any tie bars 202. A plurality of columns 120 and other structural members may combine to form an assembly (frame or structure). The columns 120 may be used to form horizontal structural member or vertical structural members. The structure may facilitate mounting of a corrugated steel sheet 112. The holes reflect a composite beam which gets filled with concrete creating a fire rating and improved structural performance.

The hollow structural members can include different beams, for example. There are different types of horizontal beams that can be used. For example, six different types of beams can be used. The beams are welded or bolted to the columns 120 during manufacturing, for example.

The columns 120 could be placed in different arrangements for the module, such as 4 or 6 or 8. The steel deck can be cantilevered to provide additional flexibility.

Aspects of the present disclosure can be additionally be used in a method for constructing a building. Such a method includes placing a plurality of modules 100 according to a floor plan to form a story of the building. A module 100 can have a deck oriented in a horizontal plane and a plurality of hollow structural members 120 extending downwardly from around a periphery of the deck. The method can involve aligning the plurality of modules 100 using alignment members 410 integrated within the plurality of modules 100. The method can involve pouring concrete into the hollow structural members 120 of the plurality of modules to form structural columns. The method can involve pouring concrete onto the decks of the plurality of modules for form structural slabs. The method can involve allowing the structural columns and structural slabs to set to complete the story of the building.

In some embodiments, the concrete is poured into injection ports of the columns (hollow structural members) after the columns have been aligned and substantially locked in-place. The alignment and locking-in place by the connecting components facilitates aligned and uniform setting of concrete. The concrete may expand in the setting or curing process such that the set concrete may form a tight fit inside the columns, i.e. the concrete may exert a radially outward stress distribution over the outer wall of the column. In some embodiments, the set concrete in combination with the structural steel outer wall of the column may form a reinforced/composite structure with enhanced strength relative to a structure with only concrete or only steel. The resulting combination of steel in concrete is a structural column.

As used herein, welding refers to brazing, liquid state welding, solid state welding, or any other metallurgical joining process, conventional or otherwise.

It will be appreciated that numerous specific details are set forth in order to provide a thorough understanding of the exemplary embodiments described herein. However, it will be understood by those of ordinary skill in the art that the embodiments described herein may be practiced without these specific details. In other instances, well-known methods, procedures and components have not been described in detail so as not to obscure the embodiments described herein. Furthermore, this description is not to be considered as limiting the scope of the embodiments described herein in any way, but rather as merely describing implementation of the various example embodiments described herein.

The description provides many example embodiments of the inventive subject matter. Although each embodiment represents a single combination of inventive elements, the inventive subject matter is considered to include all possible combinations of the disclosed elements. Thus, if one embodiment comprises elements A, B, and C, and a second embodiment comprises elements B and D, then the inventive subject matter is also considered to include other remaining combinations of A, B, C, or D, even if not explicitly disclosed.

Although the embodiments have been described in detail, it should be understood that various changes, substitutions and alterations can be made herein. Moreover, the scope of the present application is not intended to be limited to the particular embodiments of the process, machine, manufacture, composition of matter, means, methods and steps described in the specification. As can be understood, the examples described above and illustrated are intended to be exemplary only.

As will be apparent to those skilled in the art in light of the foregoing disclosure, many alterations and modifications are possible to the methods and systems described herein. While a number of exemplary aspects and embodiments have been discussed above, those of skill in the art will recognize certain modifications, permutations, additions and sub-combinations thereof. It is therefore intended that the following appended claims and claims hereafter introduced are interpreted to include all such modifications, permutations, additions and sub-combinations as may reasonably be inferred by one skilled in the art. The scope of the claims should not be limited by the embodiments set forth in the examples, but should be given the broadest interpretation consistent with the foregoing disclosure.

The present disclosure may be embodied in other specific forms without departing from its spirit or essential characteristics. The described embodiments are to be considered in all respects only as illustrative and not restrictive.

The invention claimed is:

1. A plurality of building modules that connect for modular construction of a modular building, wherein the plurality of modules are placed according to a floor plan to form a building story of the modular building, each of the building modules comprising:

a deck oriented in a horizontal plane, a plurality of hollow structural members extending downwardly from around a periphery of the deck, wherein the plurality of hollow structural members comprise at least six hollow structural members, wherein the hollow structural members connect the plurality of building modules together, one or more wall assemblies installed between the hollow structural members, and at least one alignment component to facilitate self-alignment of the building module with another building module of the plurality of building modules, wherein the at least one alignment component engages at least one complementary alignment component of the other building module to align the building module into a range of at least one of vertical alignment and horizontal alignment relative to the other building module, wherein at least one hollow structural member of the building module comprises a connecting component elongated along a longitudinal axis of the hollow structural member and extending from the top thereof, the connecting component to vertically connect the building module to the other building module for reinforcing a structure of the modular building, wherein the at least one alignment component is integrated with the at least one connecting component to connect the building module to the other building module for modular construction of the modular building, wherein at least a portion of the plurality of hollow structural members are distributed around the periphery of the deck and connect with at least a corresponding portion of other hollow structural members of the other building module, wherein the hollow structural members of the building module connected with the other hollow structural members of the other building module receive set flowable medium that sets to a solid structural material.

2. The building module of claim 1 wherein the alignment component comprises at least one of an alignment flange and an alignment pin.

3. The building module of claim 1 wherein the alignment component is made of rigid materials to provide structural support for the plurality of hollow structural members.

4. The building module of claim 1 wherein the plurality of hollow structural members comprise columns.

5. The building module of claim 1 wherein the plurality of hollow structural members have hollow areas to receive the set flowable medium, wherein the plurality of hollow structural members with the set flowable medium therein are a plurality of filled hollow structural members.

6. The building module of claim 1 wherein the deck is configured to support and engage the flowable medium that sets to a become a solid structural material poured onto the deck.

7. The building module of claim 1 wherein the deck comprises one or more reinforcement members attached thereto and configured to provide structural support for a slab of set flowable medium as a solid structural material formed on top of the deck.

8. The building module of claim 1 wherein a hollow structural member of the at least the portion of the plurality of hollow structural members that are distributed around the periphery of the deck to connect with at least the corresponding portion of the other hollow structural members of the other building module is shaped to connect with another hollow structural member of the at least the corresponding portion of the other hollow structural members of the other building module.

9. The building module of claim 1 wherein the alignment component extends upwardly from the hollow structural member.

10. The building module of claim 1 wherein the alignment component facilitates alignment in the horizontal direction.

11. The building module of claim 1 wherein the alignment component facilitates alignment in the horizontal direction.

12. The building module of claim 1 wherein a hollow structural member of the plurality of hollow structural members is shaped to receive a tie bar of another hollow structural member of another building module.

13. The building module of claim 1 wherein a hollow structural member of the plurality of hollow structural members has a built-in tie bar extending from the top thereof.

14. The building module of claim 1 wherein the plurality of hollow structural members are of a rigid material to support the set flowable medium and shaped to receive the flowable medium that sets to a solid structural material, wherein the plurality of hollow structural members are a plurality of filled hollow structural members.

15. The building module of claim 1 wherein each of the plurality of hollow structural members comprise an injection port with an opening that receives the flowable medium.

16. The building module of claim 1 further comprising an attachment mechanism for temporary connection to the other building module during erection of the building.

17. The building modules of claim 1, wherein the building module has a first axial end of a first hollow structural member, and the other building module as a second axial end of a second hollow structural member that engage to lock the first hollow structural member relative to the second hollow structural member, wherein the first hollow structural member and the second hollow structural member are filled with the set flowable medium.

* * * * *